US008170258B1

(12) United States Patent
Wells

(10) Patent No.: US 8,170,258 B1
(45) Date of Patent: May 1, 2012

(54) BASS DRUM MICROPHONE DEVICE

(76) Inventor: Paul D. Wells, Roseburg, OR (US)

( * ) Notice: Subject to any disclaimer, the term of this patent is extended or adjusted under 35 U.S.C. 154(b) by 614 days.

(21) Appl. No.: 12/362,361

(22) Filed: Jan. 29, 2009

(51) Int. Cl.
*G10D 13/02* (2006.01)

(52) U.S. Cl. ..... 381/361; 84/421

(58) Field of Classification Search ..... 381/361–363; 84/421

See application file for complete search history.

(56) References Cited

U.S. PATENT DOCUMENTS

D251,908 S 5/1979 Fujita
4,577,070 A 3/1986 Shulman
4,791,674 A * 12/1988 Drever ..... 381/368
4,837,836 A * 6/1989 Barcus ..... 381/118
5,574,236 A 11/1996 Webber
6,424,723 B1 7/2002 Jing
6,525,250 B2 * 2/2003 Goods ..... 84/411 R
7,583,810 B2 * 9/2009 Akino ..... 381/363
7,723,596 B2 * 5/2010 Kelly ..... 84/421
2005/0263656 A1 12/2005 Chen

* cited by examiner

*Primary Examiner* — David Vu
*Assistant Examiner* — Jonathan Han

(57) ABSTRACT

A bass drum microphone device for securing a microphone inside a bass drum comprising a first support bar, a second support bar, and a cross support bar, and the bars connect to form an H-shaped structure. Attached to the cross support bar is a microphone attachment component for attaching a microphone to the bass drum microphone device. The microphone can be placed at various locations within the base drum.

7 Claims, 5 Drawing Sheets

BASS DRUM MICROPHONE DEVICE

FIELD OF THE INVENTION

The present invention is directed to a clamp-like device for attaching a microphone to a bass drum.

BACKGROUND OF THE INVENTION

It can sometimes be difficult to position a microphone in the appropriate position in the area of the bass drum. Standard microphones are obtrusive. The present invention features a bass drum microphone device that allows a user to secure a microphone to the interior portion of the bass drum's shell and position the microphone at various locations.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
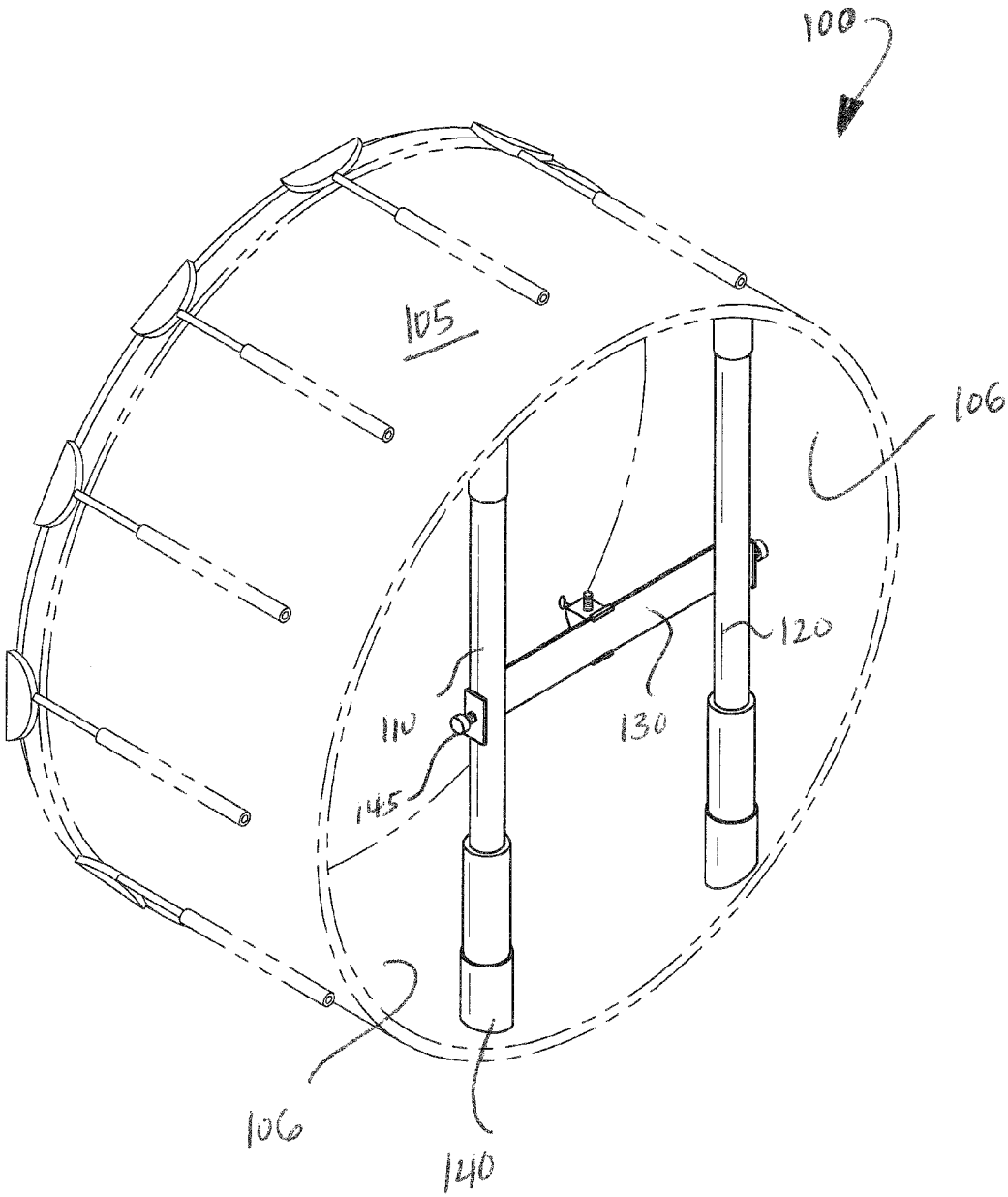
FIG. 1 is a perspective view of the bass drum microphone device of the present invention.
Figure 2:
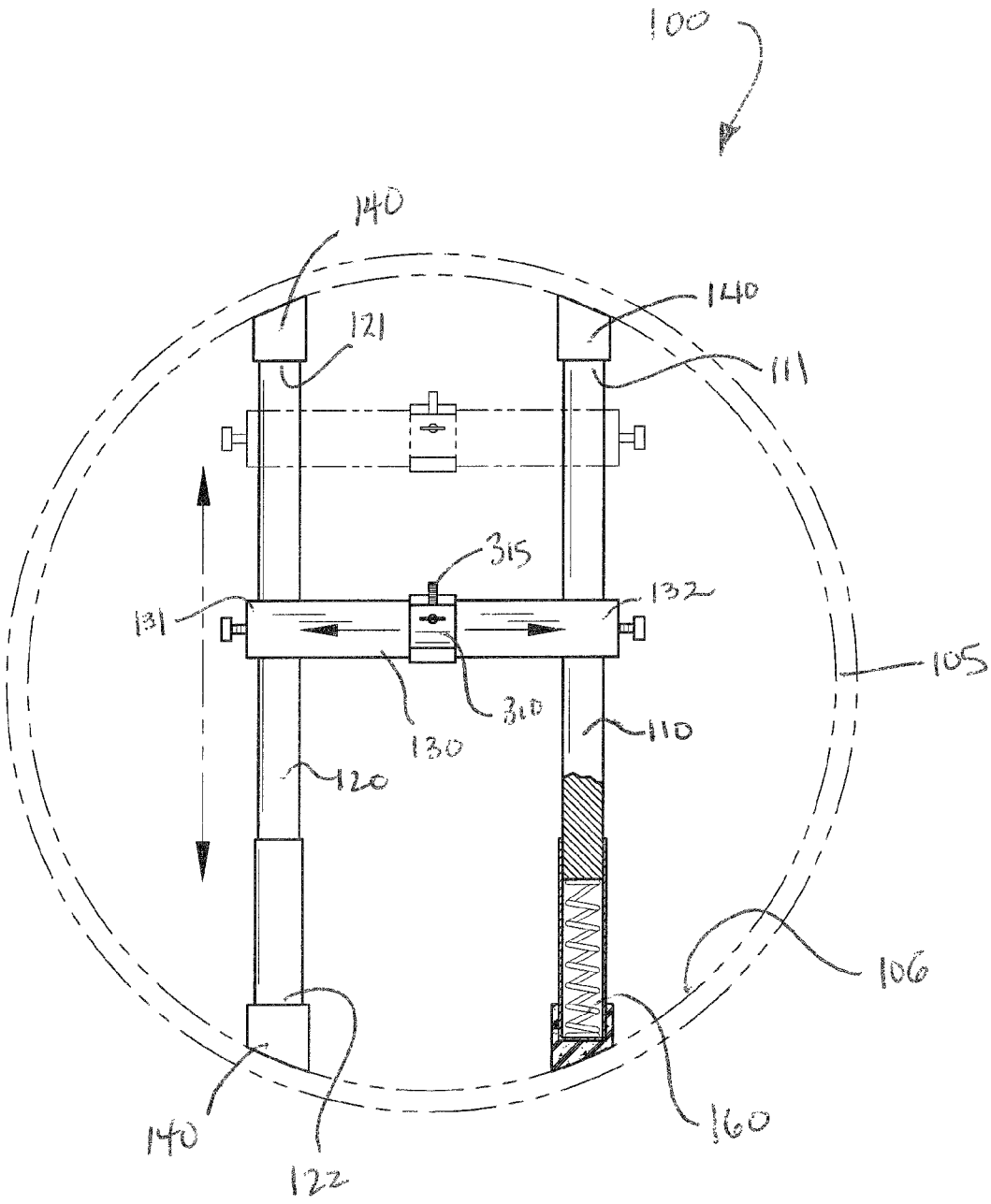
FIG. 2 is a back view and internal view of the bass drum microphone device of the present invention.
Figure 3:
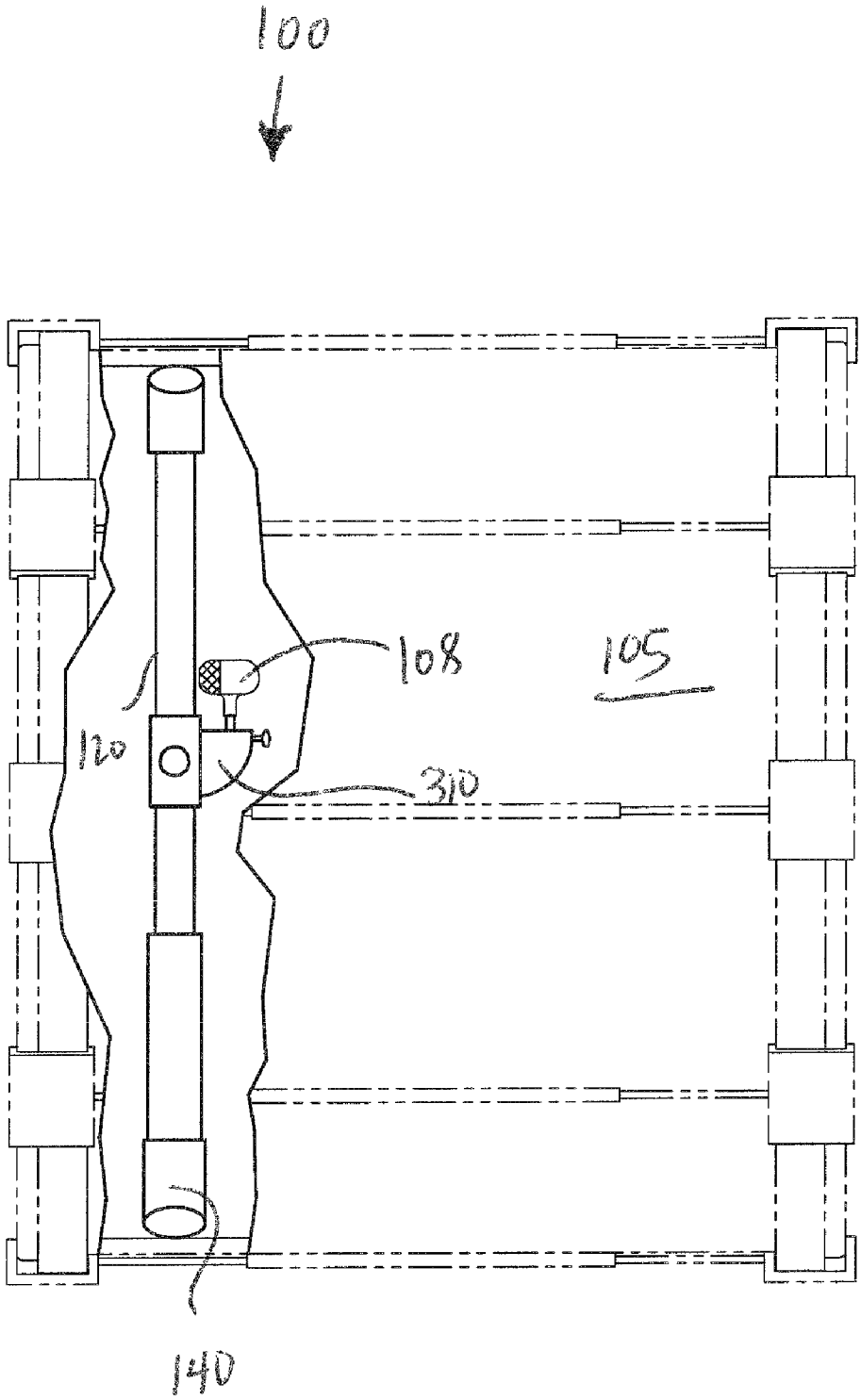
FIG. 3 is a side and internal view of the bass drum microphone device of the present invention.

The following is a listing of numbers corresponding to a particular element referred to herein:

100 bass drum microphone device
105 bass drum
106 inner surface of bass drum
108 microphone
110 first support bar
111 first end of first support bar
112 second end of first support bar
120 second support bar
121 first end of second support bar
122 second end of second support bar
130 cross support bar
131 first end of cross support bar
132 second end of cross support bar
140 grip
145 attachment means
160 spring
310 microphone attachment component
315 screw Referring now to FIGS. 1-5, the present invention features a bass drum microphone device 100 that allows a user to secure a microphone 108 to the interior surface 106 of the bass drum 105 and position the microphone 108 at various locations.

The bass drum microphone apparatus 100 comprises a first support bar 110 having a first end 111 and a second end 112, a second support bar 120 having a first end 121 and a second end 122, and a cross support bar 130. The first support bar 110 and second support bar 120 are oriented generally parallel to each other and the cross support bar 130 is generally perpendicular to the first support bar 110 and second support bar 120, forming an H-shape (see FIG. 1). In some embodiments, the first end 131 of the cross support bar 130 is attached to the first support bar 110 and the second end 132 of the cross support bar 130 is attached to the second support bar 120.

In some embodiments, the first support bar 110 and/or second support bar 120 and/or cross support bar 130 are tubular in shape. In some embodiments, the first support bar 110 and/or second support bar 120 and/or cross support bar 130 are generally flat. In some embodiments, the first support bar 110 and/or second support bar 120 comprise an inner tube telescopically received in an outer tube, allowing the support bar to be expandable and compressible via a spring 160 disposed inside the bar (see FIG. 2). Such expandable and compressible tubes are well known to one of ordinary skill in the art.

In some embodiments, the first end 131 of the cross support bar 130 is attached to the first support bar 110 via an attachment means 145. In some embodiments, the second end 132 of the cross support bar 130 is attached to the second support bar 120 via an attachment means 145. In some embodiments, the attachment means 145 includes a screw mechanism, a snap mechanism, a clip mechanism, the like, or a combination thereof. In some embodiments, the cross support bar 130 is slid ably attached to the first support bar 110 and second support bar 120 such that the cross support bar 130 can slide up and down the length of the first support bar 110 and second support bar 120 (as measured from the first end to the second end).

The device 100 of the present invention is inserted into a bass drum 105 such that the first end 111 and the second end 112 of the first support bar 110 and the first end 121 and the second end 122 of the second support bar 120 contact the inner surface 106 of the bass drum 105. In some embodiments, the first end 111 and the second end 112 of the first support bar 110 is beveled. In some embodiments, the first end 121 and the second end 122 of the second support bar 120 is beveled. The beveled shape allows the first support bar 110 and the second support bar 120 to be snugly fit against the inner surface 106 of the bass drum 105.

Figure 4:
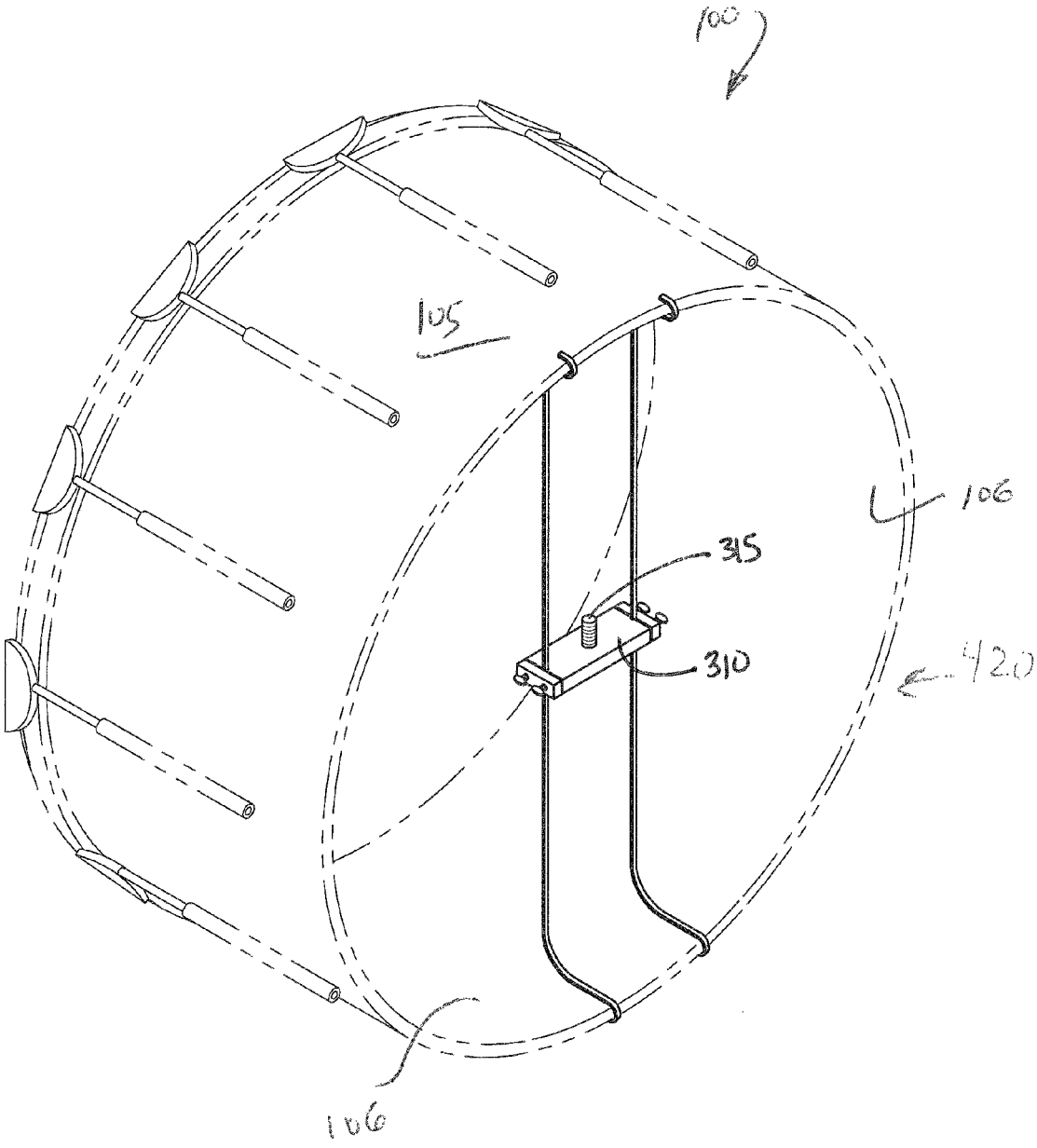
FIG. 4 is a perspective view of the bass drum microphone device of the present invention.
Figure 5:
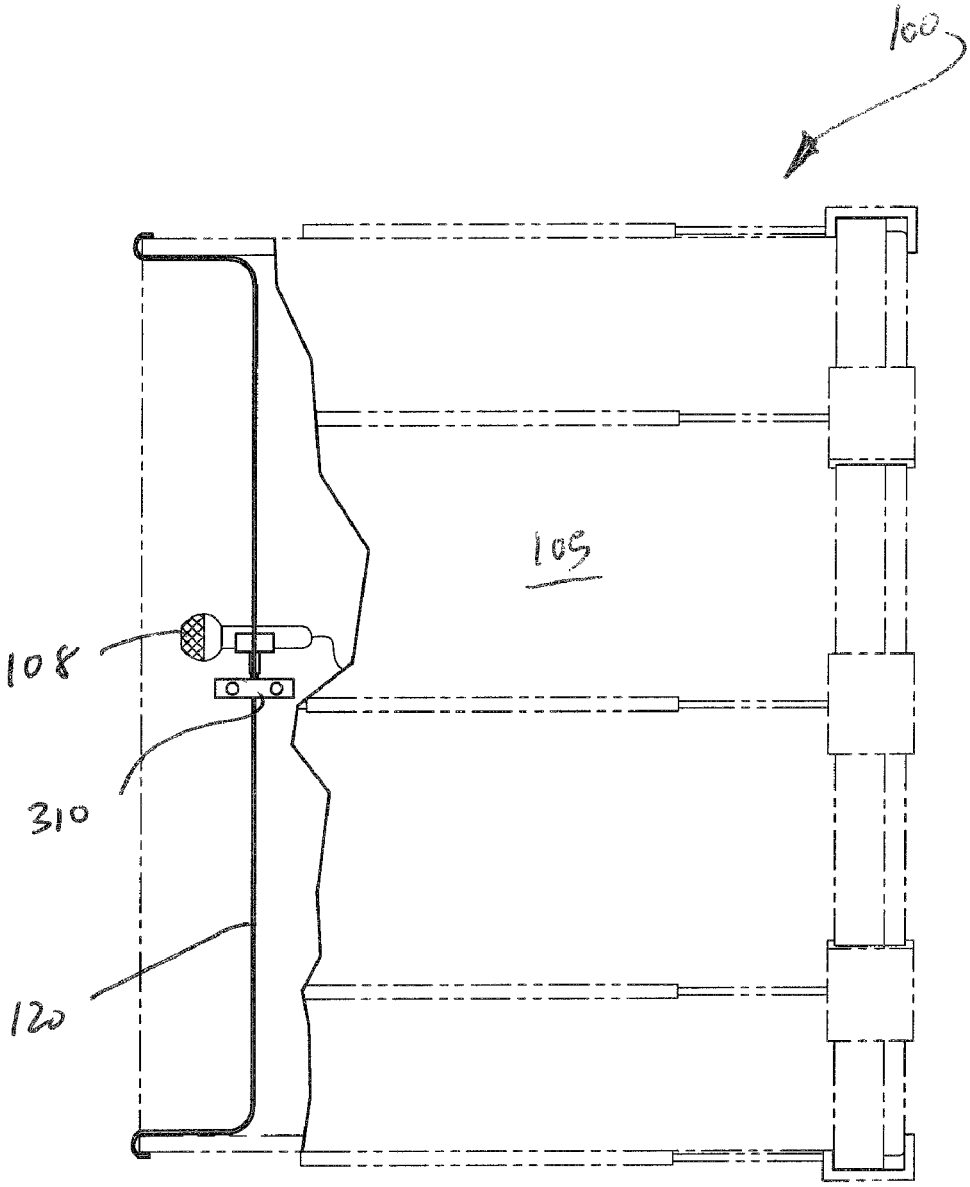
FIG. 5 is a side and internal view of the bass drum microphone device of the present invention.

In some embodiments, the first support bar 110 and the second support bar 120 attaches to the bass drum 105 via a clipping mechanism (see FIG. 4).

A microphone attachment component 310 is attached to the cross support bar 130 for allowing a microphone 180 to be attached inside the bass drum 105. In some embodiments, the microphone attachment component 310 is disposed in the middle of the cross support bar 130. In some embodiments, the microphone 108 can be attached to the attachment component 310 via a screw 315.

In some embodiments, a 140 grip is disposed on the first end 111 and the second end 112 of the first support bar 110. In some embodiments, a 140 grip is disposed on the first end 121 and the second end 122 of the second support bar 120. The grip 140 can help stabilize the first support bar 110 and/or the second support bar 120 inside the bass drum 105.

The disclosures of the following U.S. patents are incorporated in their entirety by reference herein: U.S. Pat. No. 6,424,723; U.S. Pat. Application No. 2005/0263656; U.S. Pat. No. 4,577,070; U.S. Pat. No. 5,574,236; U.S. Pat. No. 4,791,674.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A bass drum microphone device for allowing a user to secure a microphone inside a bass drum having an interior surface, said bass drum microphone device comprising:

(a) a first support bar having a first end and a second end, the first end and second end both being beveled;

(b) a second support bar having a first end and a second end, the first end and second end both being beveled;

(c) a cross support bar having a first end and a second end; wherein the first support bar and the second support bar are oriented generally parallel to each other, wherein the first end of the cross support bar is slidably attached to the first support bar via an first attachment means and the second end of the cross support bar is slidably attached to the second support bar via a second attachment means;

(d) a microphone attachment component removably attached to the cross support bar for allowing a microphone to be attached the cross support bar;

wherein the bass drum microphone device is inserted into the bass drum such that the first end and the second end of the first support bar and the first end and the second end of the second support bar snugly contact the inner surface of the bass drum; wherein the bass drum microphone device allows the user to position the microphone at various locations inside the bass drum.

2. The bass drum microphone device of claim 1, wherein the first support bar and the second support bar are tubular in shape.

3. The bass drum microphone device of claim 1, wherein the first support bar and the second support bar and are generally flat.

4. The bass drum microphone device of claim 2, wherein the first support bar and the second support bar each comprise an inner tube telescopically received in an outer tube.

5. The bass drum microphone device of claim 1, wherein the first attachment means and second attachment means includes a screw mechanism, a snap mechanism, a clip mechanism, the like, or a combination thereof.

6. The bass drum microphone device of claim 1, wherein a grip is disposed on the first end and the second end of the first support bar, the grip helping to stabilize the first support bar inside the base drum.

7. The bass drum microphone device of claim 1, wherein a grip is disposed on the first end and the second end of the second support bar, the grip helping to stabilize the second support bar inside the bass drum.

* * * * *